US005718073A

United States Patent [19]

Sachse et al.

[11] Patent Number: 5,718,073

[45] Date of Patent: Feb. 17, 1998

[54] MUZZLE LOADING RIFLE

[75] Inventors: T. Nick Sachse, Elizabethtown, Ky.; Kenneth W. Soucy, Neuchatel, Switzerland

[73] Assignee: Remington Arms Company, Inc., Madison, N.C.

[21] Appl. No.: 822,522

[22] Filed: Mar. 26, 1997

Related U.S. Application Data

[63] Continuation of Ser. No. 603,586, Feb. 21, 1996, abandoned.

[51] Int. Cl.[6] ..... F41C 9/08

[52] U.S. Cl. ..... 42/51; 89/1.3; 42/16

[58] Field of Search ..... 89/1.3; 42/51, 42/16–19

[56] References Cited

U.S. PATENT DOCUMENTS

| | | | |
|---|---|---|---|
| 2,514,981 | 7/1950 | Walker et al. | 42/69.01 |
| 3,631,620 | 1/1972 | Ohira | 42/16 |
| 3,757,447 | 9/1973 | Rowe | 42/51 |
| 4,700,499 | 10/1987 | Knight | 42/51 |
| 4,715,139 | 12/1987 | Rodney, Jr. | 42/51 |
| 5,109,622 | 5/1992 | Echeberria | 42/51 |
| 5,408,776 | 4/1995 | Mahn et al. | 42/51 |

FOREIGN PATENT DOCUMENTS

| | | | |
|---|---|---|---|
| 832483 | 9/1938 | France | 89/1.3 |

OTHER PUBLICATIONS

J.M. Wickenden, Building an Unorthodox Slug Rifle, 1978, pp. 36–43.

*Primary Examiner*—Stephen M. Johnson
*Attorney, Agent, or Firm*—Donald W. Huntley

[57] ABSTRACT

An in-line muzzle-loading firearm in which the firing pin is cocked by a bolt action permits the use of a stronger firing pin spring, a firing pin of reduced mass, and reduced firing pin travel, resulting in reduced lock times.

11 Claims, 6 Drawing Sheets

17
15
13
16
10
11
6
12
9
18
7

MUZZLE LOADING RIFLE

This application is a continuation of application Ser. No. 08/603,586, filed Feb. 21, 1996, now abandoned.

BACKGROUND OF THE INVENTION

This invention relates generally to firearms and more particularly to muzzle loading firearms with improved ignition systems.

Hunting with muzzle loading firearms has become increasingly popular. Reasons for this popularity include the enjoyment of manually loading the powder and projectile into the muzzle, and then packing it with a ramrod. As evidence of the increasing popularity of muzzle loading firearms, some states have separate hunting seasons for sportsmen with muzzle loading firearms. Despite their increased popularity, muzzle loading firearms have presented several problems to those that use them. The most important problem associated with previous muzzle loading firearms relates to the accuracy of the weapon, a paramount concern to the user. The accuracy of a weapon is inversely related to, inter alia, the lock time of the weapon. Lock time is measured from the time the trigger is squeezed until the powder charge launching the projectile actually fires. Even minute delays in the lock time cause inaccuracies due to the difficulty of holding the weapon still over increased periods of time. Thus, developments that tend to decrease lock time increase the functionality of the weapon by increasing the weapon's accuracy.

In response to the problem of accuracy, muzzle loading firearms have been modified over the years. In the original flintlock muzzle-loading rifles, the flint was mounted on a traditional swing hammer, which, when released by the trigger, struck a frizzen, producing a spark which ignited the primer charge in a pan. The detonation of the primer charge was carried though a flash hole to the main charge in the barrel, causing the powder which was loaded through the muzzle to explode, thereby propelling the projectile. Later developments involved the replacement of the pan with a self contained primer charge or percussion cap, which was struck directly by the hammer, and the resulting detonation charge was similarly carried to the main charge in the barrel.

Mechanisms previously used for initiating such impact sensitive primer charges involved a spring loaded hammer or firing pin which was positioned on either the top or side of the firearm. More recently, in-line muzzle-loading rifles were developed, in which an impact sensitive primer or percussion cap, connected to the barrel by a flash hole, is detonated by an in-line striker. Such strikers are drawn back manually, as illustrated, for example, in Mahn et al., U.S. Pat. No. 5,408,776.

Despite the advances that have been made over the decades, a continuing need exists for a cocking and firing mechanism for muzzle loading firearms that provides a combination of ease of cocking with minimization of the lock time of the firearm upon firing.

SUMMARY OF THE INVENTION

The present invention provides an improved muzzle loading firearm which combines mechanically assisted cocking and markedly reduced lock times compared to previously available mechanisms.

Specifically, the instant invention provides a muzzle loading firearm comprising a barrel having a front end and a closed rear end and attached to a receiver; means at the rear end of the barrel for receiving a percussion cap operatively connected to a flash hole formed in the rear end of the barrel; a bolt assembly having a front and a rear end and positioned within the receiver behind and substantially aligned with the barrel, the bolt assembly being operatively connected to a trigger assembly and comprising a bolt body, a firing pin within the bolt body, a spring positioned to bias the firing pin forward, a firing pin head at the rear end of the firing pin positioned to connect the firing pin to the trigger assembly; a cam cut in the bolt body to engage the firing pin head for cocking the firing pin, a bolt plug at the rear end of the bolt assembly to retain the firing pin, a bolt handle on the bolt body for movement of the bolt assembly longitudinally and rotationally within the receiver; a cam follower on the bolt body; and a cam cut in the receiver positioned to engage the cam follower on the bolt body.

DETAILED DESCRIPTION OF THE INVENTION

Figure 1:
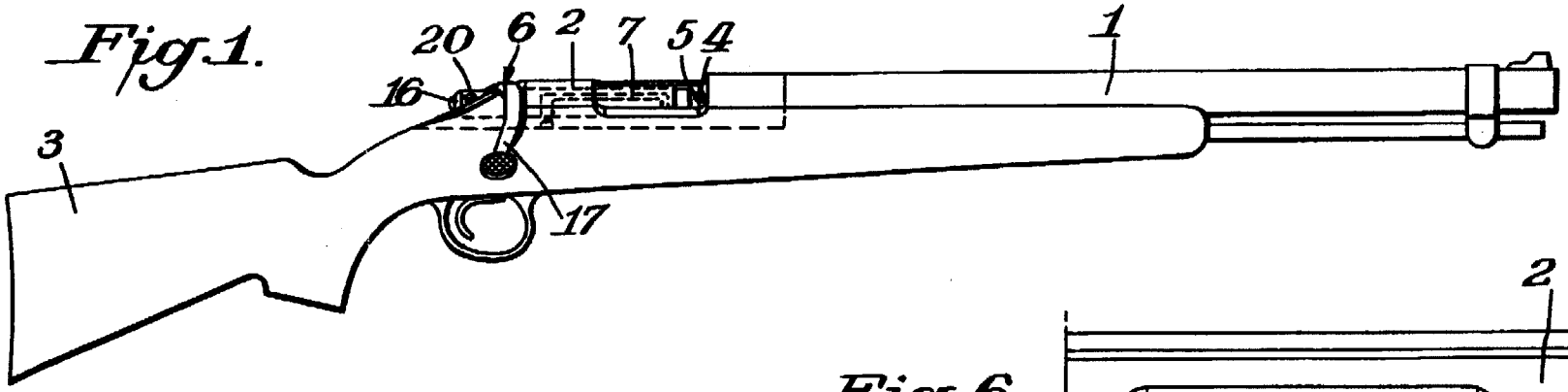
FIG. 1 is a side elevational view of a first embodiment of a firearm of the invention, with the bolt in the closed position and cocked.

The present invention will be more fully understood by reference to the drawings, of which FIGS. 1 to 6 depict a first embodiment of a firearm of the invention, while FIGS. 6 to 11 depict a second embodiment of a firearm of the invention. Like numbers refer to like elements in the several figures. In the following description, the terms "front," "rear," "up,"

and "down" refer to the firearm in its horizontal position. Variations and modifications of these embodiments can be substituted without departing from the principles of the invention, as will be evident to those skilled in the art.

In FIGS. 1 to 6, the firearm comprises barrel 1, attached to receiver 2, both of which are encased in stock 3. The rearward end of the barrel is closed with breech plug 4, having nipple 5 for engagement with a percussion cap, not shown. The receiver has a cam cut 14 formed therein, the cam cut being positioned to engage a cam follower 17 on the bolt body, which in this embodiment is the bolt handle.

Bolt assembly 6 comprises bolt body 7, firing pin spring 8, firing pin 9, and cam follower 17. Bolt plug 15, at the rear end of the bolt assembly 6, serves to retain the firing pin 9 and the firing pin spring 8. The bolt assembly 6 is cocked and retracted by use of the bolt handle, which is on the bolt body 7. The firing pin head 16, at the rear end of the firing pin 9, comprises projections 18, which engage the trigger assembly, and which interact with a cam cut 13 formed in the bok body to cock the firing pin 9. The firing pin head projections 18 also serve to release the firing pin 9 upon activation of the trigger assembly.

The cam cut 13 in the bolt body interacts with the firing pin head 16 to cock the firing pin 9 upon upward rotation of the bolt handle after firing. The firing pin head interacts with the trigger assembly to further cock the firing pin when the bolt handle is rotated downward prior to firing.

The trigger assembly, while not central to the present invention, typically comprises trigger 19, safety 20, and sear, not shown. Representative trigger assemblies which can be used include, for example, that shown in Walker et al., U.S. Pat. No. 2,514,981, and that used on the Remington Model 700 Rifle, commercially available from the Remington Arms Company, Inc.

Figures 2, 4, 5A, 5B:
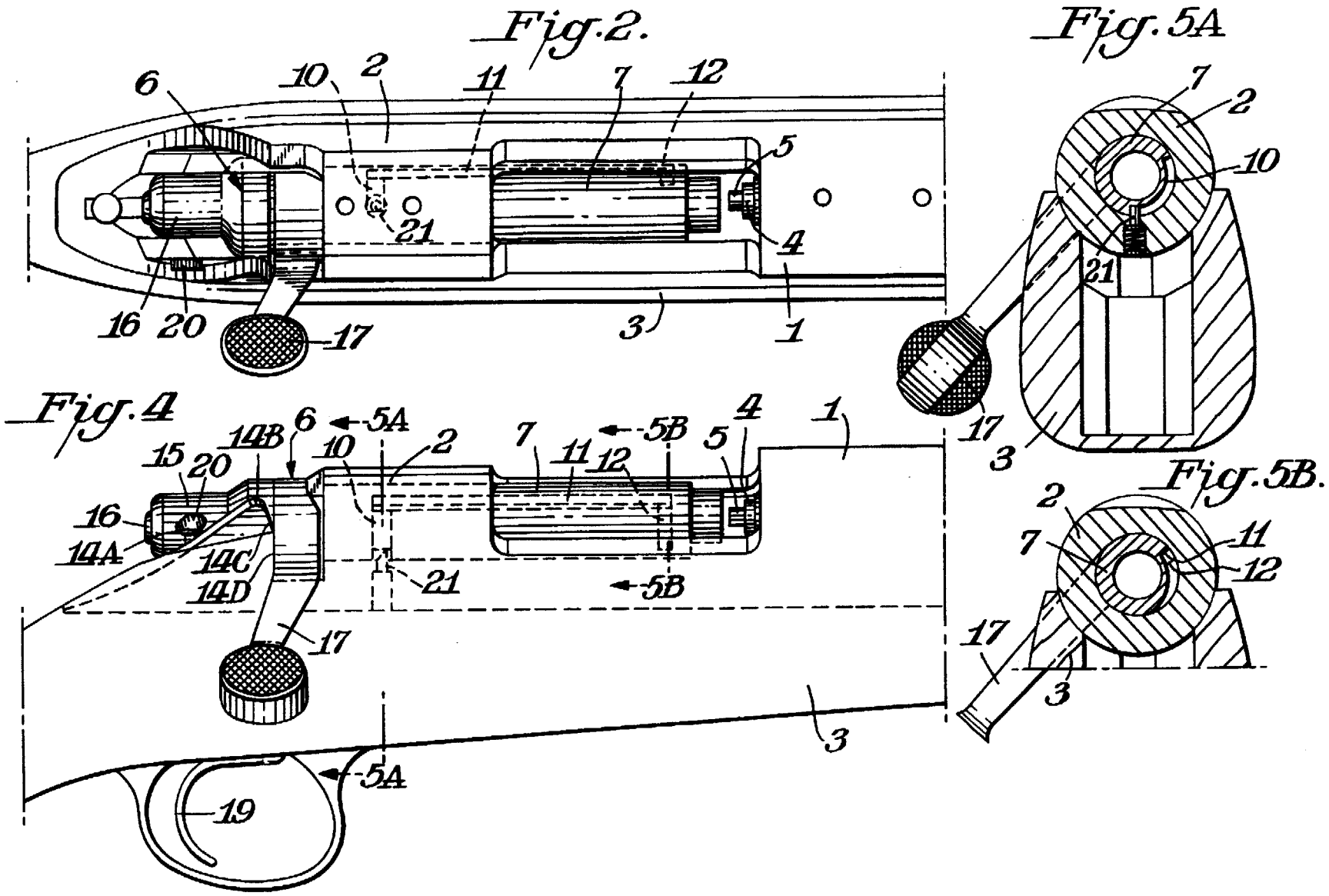
FIG. 2 is a fragmental top plan view of a firearm of FIG. 1 and partially broken away.
FIG. 4 is a side elevational view of a first embodiment of a firearm of the invention, partially broken away with the bolt assembly closed.
FIG. 5A is a cross sectional and elevational view of a firearm of the invention, taken at section 5A—5A of FIG. 4.
FIG. 5B is a cross sectional and elevational view of a firearm of the invention, taken at section 5B—5B of FIG. 4.
Figure 3:
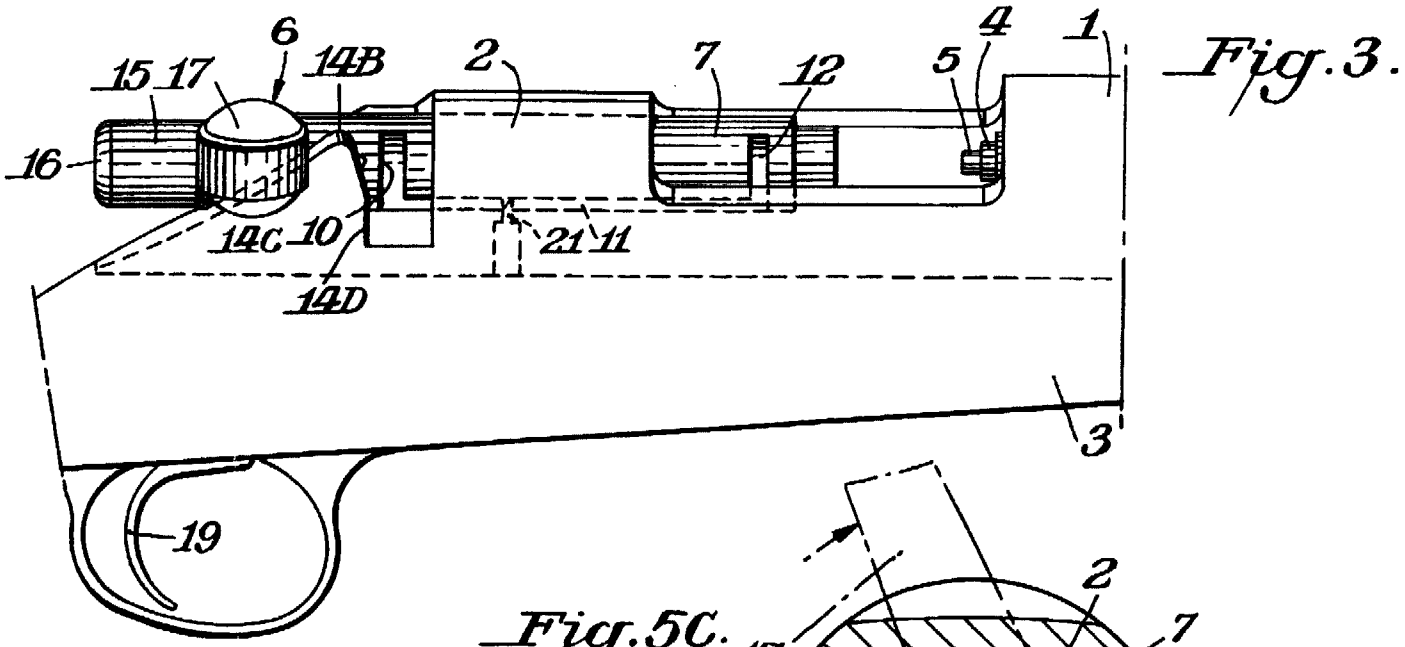
FIG. 3 is a fragmental side view of a first embodiment of a firearm of the invention, partially broken away to show the operating mechanism with the bolt partially retracted.
Figure 5C:
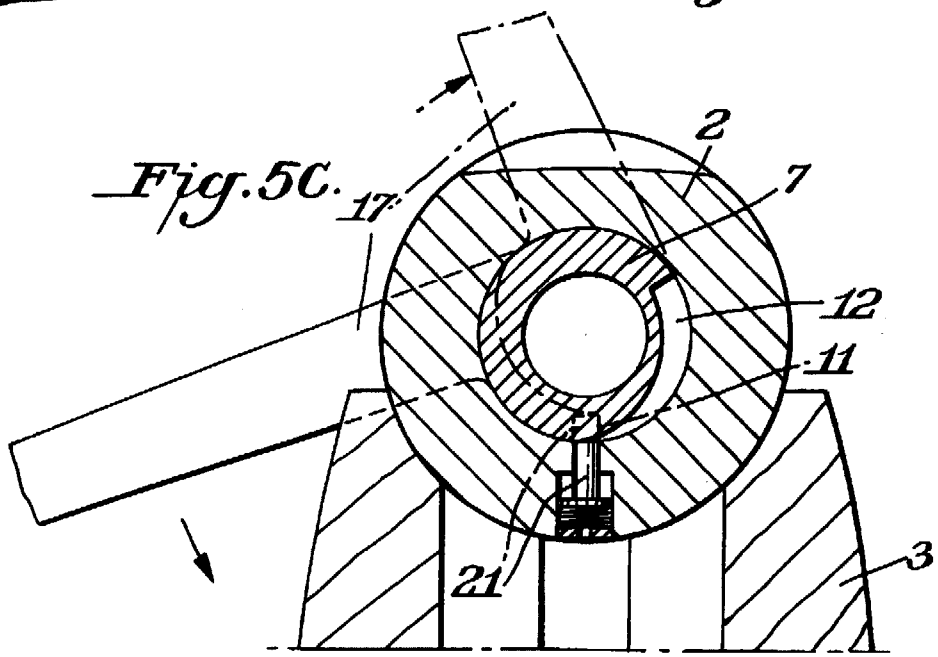
FIG. 5C is a cross sectional and elevational view of a firearm of the invention, taken at section 5A—5A of FIG. 4 and showing the bolt assembly in the retracted position.
Figure 3A:
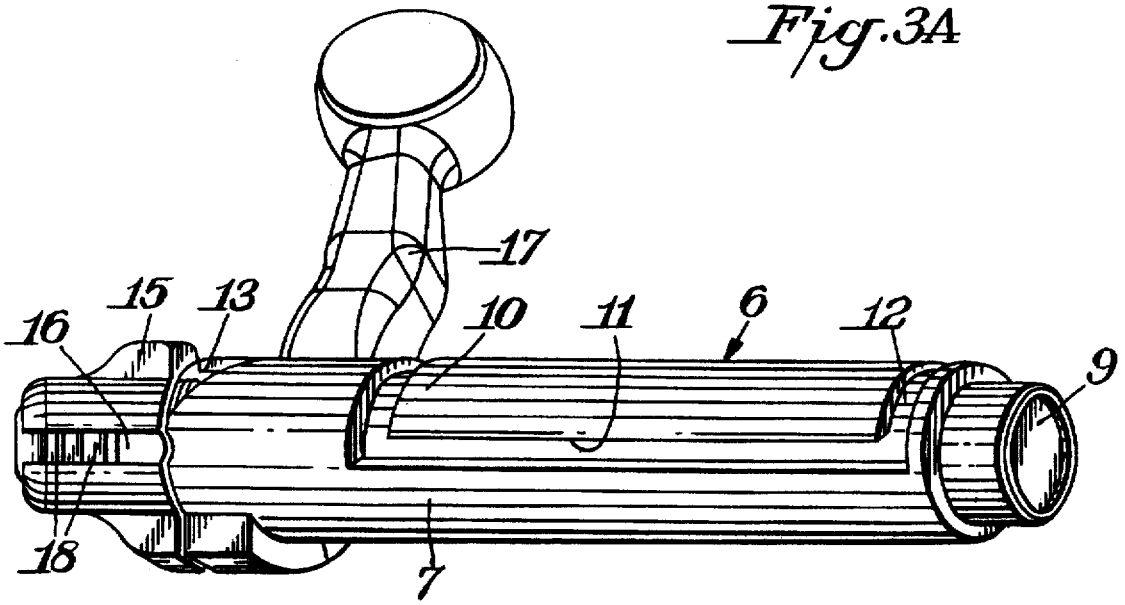
FIG. 3A is a bottom perspective view of a bolt assembly, removed from a first embodiment of a firearm of the invention.

A slot is preferably formed in the bolt body and comprises rearward transverse section 10, connected to a longitudinal middle section 11, which is connected to a forward transverse section 12. The rearward transverse section 10 of the slot is wider than the longitudinal middle and forward transverse sections. The forward transverse section 12, beginning at its intersection with the longitudinal middle section, becomes gradually more shallow until it is finally flush with the surface of the bolt body at its terminus. A bolt stop detent pin 21 is positioned within the receiver and biased to interact with the slot in the bolt body to retain the bolt assembly within the receiver. The rotation of the fully retracted bolt assembly so that the forward transverse section of the slot in the bolt body compresses the detent pin permits the removal of the bolt assembly from the receiver. Generally, the slot is wider than the bolt stop detent pin, providing clearance such that the pin need not contact the slot. In addition, the greater width of the rearward transverse section 10 permits some forward motion of the bolt assembly while it is being rotated and cocked. More specifically, the greater width of the rearward transverse section of the slot provides enough clearance for the detent pin that it will not contact the slot when the bolt assembly is in the final stages of being cocked, that stage being defined by the interaction of the bolt handle/cam follower with the cam cut in the rear of the receiver as the bolt handle is rotated down into the cocked and locked position. The interaction of the slot and the bolt stop detent pin is shown in FIGS. 5A–5C.

The bolt stop detent pin 21 is rounded at the end which interacts with the slot in the bolt body, the rounded end having an angular face sloping downward from front to rear. The angular downward sloping face at the end of the detent pin is adapted to allow insertion of the bolt assembly, much like the way a door latch operates when a door is closed. When the bolt assembly is inserted into the rear of the receiver, it depresses the detent pin until the bolt assembly is in a position so that the pin enters the slot, and the pin snaps into place to secure the bolt assembly. The pin remains in the biased position until the bolt assembly is rotated so that the forward transverse section of the slot on the bolt body depresses the pin, allowing the bolt assembly to be removed from the receiver.

The cam cut 14 in the receiver has a rear portion 14A which slopes upward towards the front to its highest point 14B. This rearward portion does not function as a cam cut, but is merely aesthetic, considering an alternative design of a square block extending rearward from the highest point 14B of the cam cut in the receiver. At the highest point 14B of the slope of the rear portion, a transitional section 14C extends downward and forward until it connects with a final section 14D extending downward and substantially perpendicular to the barrel of the firearm. The cam cut 14 is positioned at its highest point 14B to engage the cam follower 17 on the bolt body to restrict and guide the motion of the bolt assembly 6 in its longitudinal and transverse motion in cocking the firearm. In this first embodiment of a firearm of the invention here shown, the bolt handle is the cam follower and also provides a means of moving the bolt assembly longitudinally and rotationally within the receiver.

In this embodiment, the bolt handle functions as a lever, providing a manual means of cocking the firing pin and a mechanical means of cocking the firing pin by operating as the cam follower and interacting with the cam cut 14 in the rear of the receiver. Specifically, the bolt handle moves forward along a plane parallel to the highest point of the cam cut 14B, until the bolt handle hits the highest point and then comes into contact with the cam cut surface as it is rotated downward to cock the firearm. While the bolt assembly is being moved forward by the bolt handle, the firing pin head interacts with the trigger assembly, and the firing pin is thus held in position as the bolt assembly moves forward. While in this position, the firing pin is also biased forward by the firing pin spring, and is almost fully cocked. As the cam follower travels forward along the transitional section 14C of the cam cut, the bolt assembly is forced to rotate downward while still continuing, to a lesser extent, its forward motion, thus further cocking the firing pin. As the cam follower enters the final section 14D of the cam cut, it does not move forward but rotates downward into a locked position. At this point the firearm is cocked and ready to fire.

Figure 6:
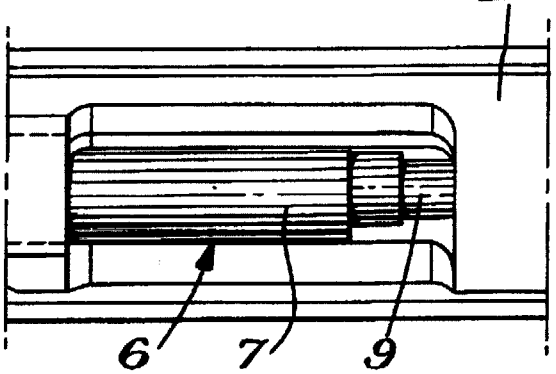
FIG. 6 is a view of the bolt assembly in combination with the receiver.
Figure 7:
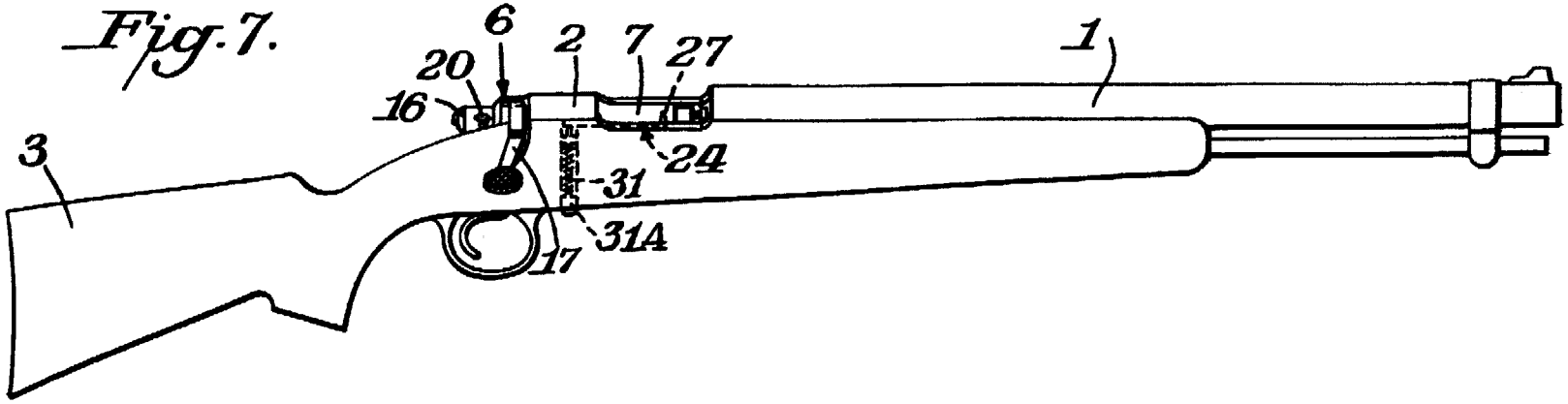
FIG. 7 is a side elevational view of a second embodiment of a firearm of the invention, with the bolt in the closed position and cocked.

FIG. 6 is a top plan view of both a first and a second embodiment of a firearm of the invention showing the bolt assembly 6 and firing pin 9 in the fired position. In this figure, the firing pin 9 is shown fully extended to engage the nipple or the percussion cap, if a percussion cap has been placed on the nipple. In this position, the firing pin 9 extends forward, contacting the nipple for engagement with a percussion cap, not shown, which fits over the nipple. While the firing pin 9 has moved forward in this figure, the hollow bolt assembly 6 has remained in the same position, so that the firing pin 9 extends beyond the bolt assembly 6. The forward motion of the firing pin, absent the nipple/percussion cap, is defined by the interaction of the cam cut in the bolt body 13 with the firing pin head 16. Thus the release of the cocked firing pin transfers energy to the percussion cap before the firing pin reaches the limit of its forward motion as defined above.

In FIGS. 6 to 11, a second embodiment of the firearm is shown which comprises barrel 1, attached to receiver 2, both of which are encased in stock 3. The rearward end of the barrel is closed with breech plug 4, having nipple 5 for engagement with a percussion cap, not shown. Bolt assembly 6 comprises bolt body 7, firing pin spring 8, firing pin 9, bolt handle 17, and cam follower 27. The cam follower is positioned within an aperture formed in the bolt body. Bolt plug 15, at the rear end of the bolt assembly 6, serves to retain the firing pin 9 and the firing pin spring 8. The bolt assembly 6 is cocked and retracted by use of the bolt handle.

The cam follower 27 on the bolt body is biased to interact with a cam cut 24 in the receiver. The cam follower is biased away from the bolt body, preferably by a coil spring 27B which is positioned between the cam follower and the bolt body and within the aperture formed in the bolt body. The cam follower can be secured within the bolt body by suitable mechanical means, here shown as a retainer bushing 27C, the bushing being press fit into the aperture formed in the bolt body.

The cam cut in the receiver 24 is positioned to engage the cam follower 27 on the bolt body to restrict and guide the motion of the bolt assembly 6 in its longitudinal and transverse motion in cocking the firearm. The cam cut in the receiver comprises rearward longitudinal section 25, connected to forward transverse section 26 by angular or arcuate section 26A. The interaction of the cam follower with the longitudinal section of the cam cut in the receiver serves to guide and restrict the motion of the bolt assembly, while the interaction of the cam follower with the angular or arcuate section 26A and the transverse section 26 of the cam cut 24 serves to cock the firing pin and serves an additional locking function when the bolt assembly 6 is in the fully closed position.

To remove the bolt assembly from the receiver, the bolt is pulled rearward so that the cam follower is positioned to interact with a release mechanism pin 31 in the receiver. The release mechanism pin extends upward from its button end 31B, which is here shown below the receiver and in front of the trigger assembly, to a terminal end 31C in the bottom of the receiver, the terminal end positioned at the rear terminal end of the rearward longitudinal section 25 of the cam cut in the receiver. The release mechanism pin, which is biased downward, is activated by depressing its button end, causing the terminal end to extend into the rear terminal end of the longitudinal section 25 of the cam cut in the receiver. When the bolt assembly is retracted, the terminal end 31C of the release mechanism pin, when depressed, compresses the cam follower 27 so that the bolt assembly can be removed from the receiver. To insert the bolt assembly into the receiver, the cam follower is manually depressed as the bolt is inserted into the rear of the receiver. The cam follower remains compressed until the bolt is inserted far enough into the receiver so that the cam follower can interact with the cam cut in the receiver.

Figure 9:
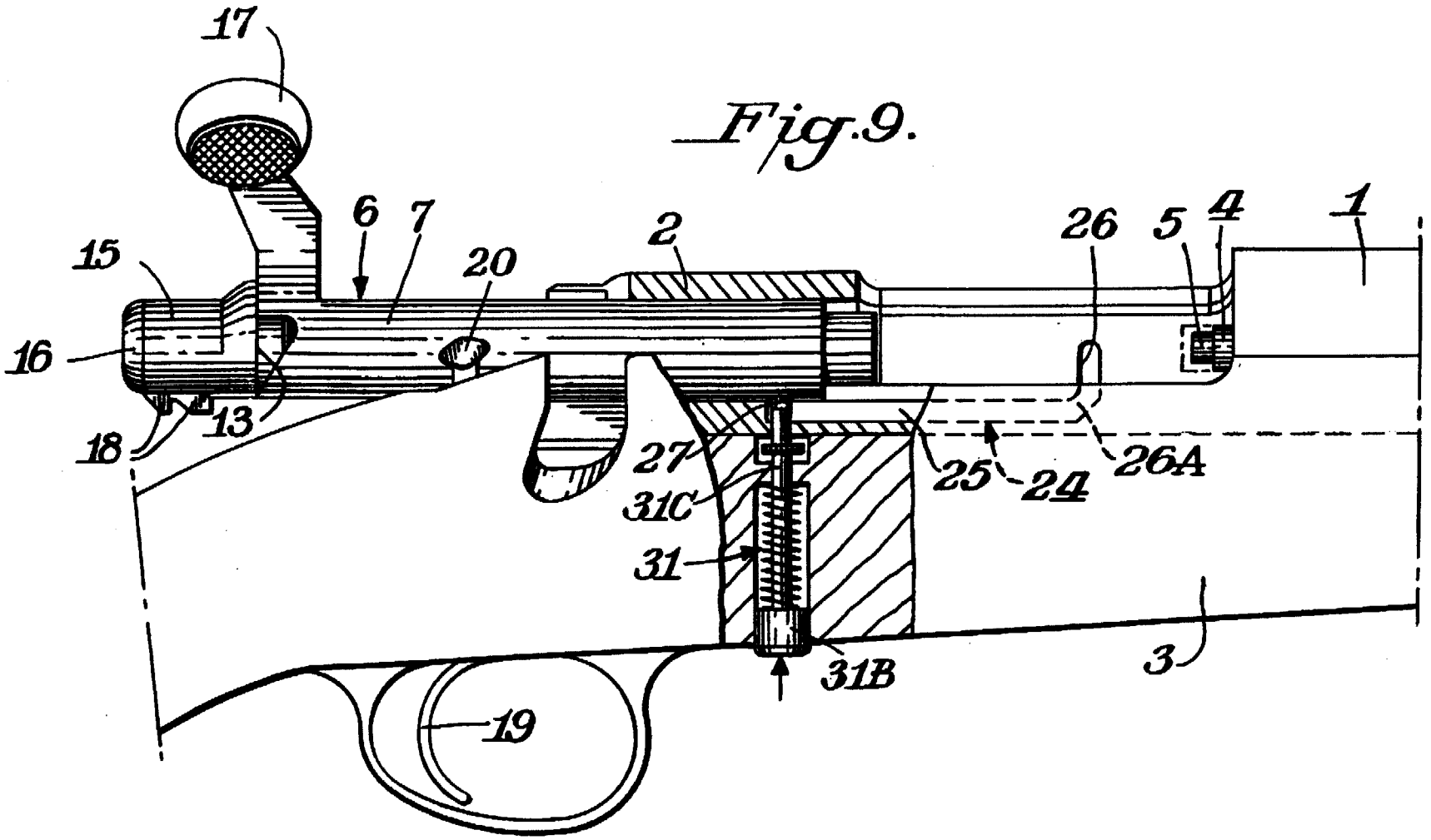
FIG. 9 is a fragmental side view of a second embodiment of a firearm of the invention, partially broken away to show the operating mechanism with the bolt fully retracted.

FIG. 9 is a fragmental side view of the bolt assembly 6 fully retracted. In the rear of the bolt body 7 is a cam cut 13, which interacts with the firing pin head 16 to cock the firing pin 9 upon rotation of the bolt handle 17 after firing. The firing pin head 16, at the rear end of the firing pin 9, comprises projections 18, which engage the trigger assembly (not shown), and which interact with the cam cut 13 in the bolt body to cock the firing pin 9. The firing pin head projections 18 also serve to release the firing pin 9 upon activation of the trigger assembly. The trigger assembly, while not central to the present invention, typically comprises trigger 19, safety 20, and sear, not shown. Trigger assemblies which can be used are discussed above.

Figure 10:
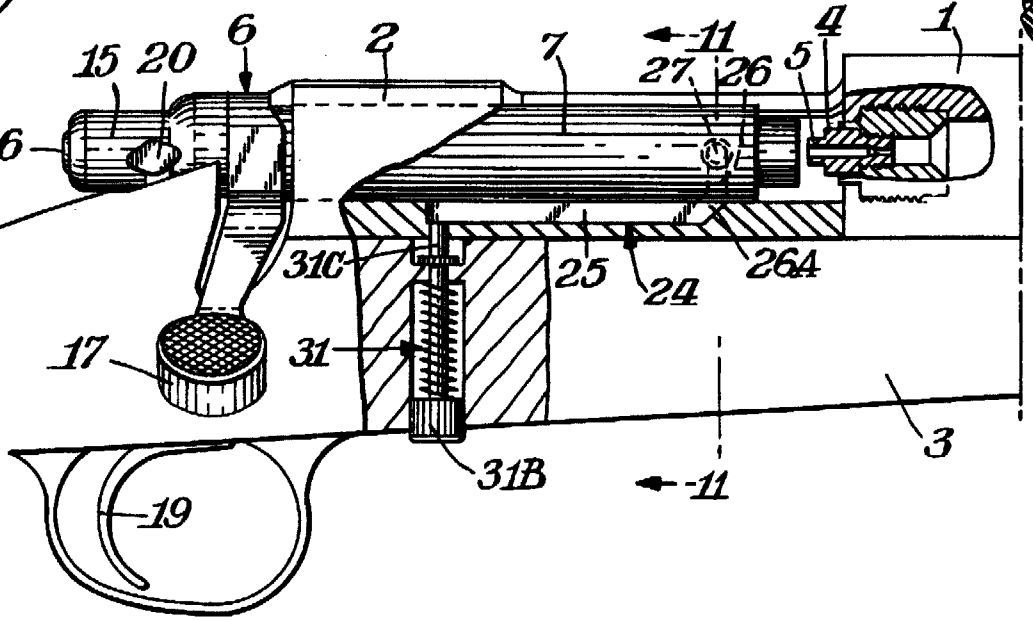
FIG. 10 is a side elevational view of a second embodiment of a firearm of the invention, partially broken away to show the bolt release mechanism and with the bolt assembly in the closed position.

FIG. 10 is a side elevational view of the firearm. The receiver is partially broken away to show the bolt assembly 6 and its composite parts in the closed and cocked position, as well as the breech plug 4 and nipple 5. The bolt body is partially broken away to show the transverse section of the cam cut and the cam follower 27 when the bolt assembly is in the closed, locked and cocked position. The stock 3 is also partially broken away to show the release mechanism pin 31. The stock and the receiver are partially broken away to show the longitudinal section of the cam cut 25 in the receiver.

Figure 11:
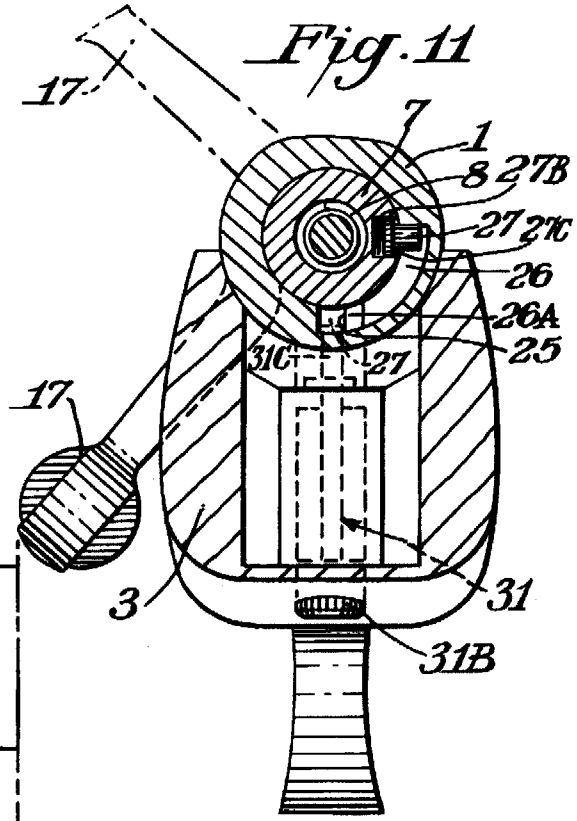
FIG. 11 is a cross sectional and elevational view of a firearm of the invention, taken at section 11—11 of FIG. 10.
Figure 8:
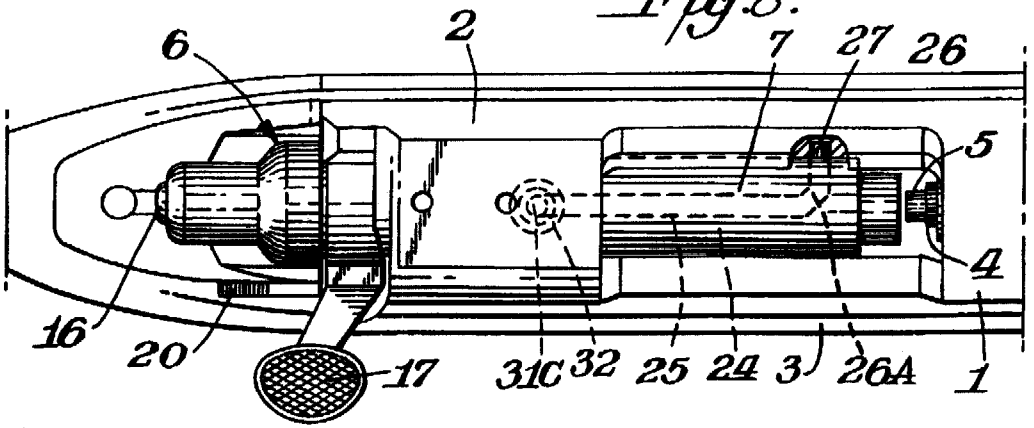
FIG. 8 is a fragmental top plan view of a firearm of FIG. 7 and partially broken away.

FIG. 11 is a cross sectional and elevational view of the firearm, showing the positioning of the cam follower 27 within the transverse section of the cam cut in the receiver 26 when the bolt assembly is in the closed position. FIG. 11 also shows the release mechanism pin 31.

The improved mechanism of the present invention, in its various possible embodiments, provides a desirable combination of advantages. Specifically, the mechanically assisted cocking mechanism, through the combination of the handle operation of the bolt assembly, the interaction of the cam follower with the transverse section of the cam cut, and the interaction of the trigger assembly with the firing pin head and the rear cam cut, markedly increases the ease and speed with which the firearm can be cocked. This, in turn, enables the use of substantially higher strength springs and a firing pin having a lighter mass. With the higher strength spring for the firing pin, the firing pin can be positioned closer to the percussion cap and can be of a lesser mass than has been possible with prior mechanisms, thus decreasing the lock time upon firing.

We claim:

1. A muzzle loading firearm comprising a barrel having a front end and a closed rear end and attached to a receiver; means for receiving a percussion cap operatively connected to a flash hole formed in the rear end of the barrel; a bolt assembly having a front and a rear end and positioned within the receiver behind and substantially aligned with the barrel, the bolt assembly being operatively connected to a trigger assembly and comprising a bolt body, a firing pin within the bolt body, a spring positioned within the bolt body to bias the firing pin forward means on the firing pin positioned to connect the firing pin to the trigger assembly, means for cocking the firing pin, means for retaining the firing pin and firing pin spring within the bolt body, and means for movement of the bolt assembly longitudinally and rotationally within the receiver; a cam follower on a middle portion of the bolt body;, and a cam cut in the receiver positioned to engage the cam follower on the bolt body.

2. A firearm of claim 1 wherein the cam cut in the receiver comprises a longitudinal section substantially aligned with the barrel, connected at its forward end to a transverse section.

3. A firearm of claim 2 wherein the cam cut in the receiver further comprises a transitional section extending at an angle and connecting the longitudinal section with the transverse section.

4. A firearm of claim 2 wherein the cam cut in the receiver further comprises an arcuately extending transitional section connecting the longitudinal section with the transverse section.

5. A firearm of claim 2 further comprising a release mechanism pin located in the receiver and positioned directly below the rearward end of the longitudinal section of the cam cut in the receiver.

6. A firearm of claim 1 wherein the means cocking the firing pin is a second cam cut in the rear of the bolt body positioned to interact with the means for connecting the firing pin to the trigger assembly.

7. A muzzle loading firearm comprising a barrel having a front end and a closed rear end and attached to a receiver;

means for receiving a percussion cap operatively connected to a flash hole formed in the rear end of the barrel; a bolt assembly having a front and a rear end and positioned within the receiver behind and substantially aligned with the barrel, the bolt assembly being operatively connected to a trigger assembly and comprising a bolt body, a firing pin within the bolt body, a spring positioned within the bolt body to bias the firing pin forward, means on the firing pin positioned to connect the firing pin to the trigger assembly, means for cocking the firing pin, means for retaining the firing pin and firing pin spring within the bolt body, and a bolt handle on the bolt body for movement of the bolt assembly longitudinally and rotationally within the receiver; wherein the bolt handle is on the bolt body and positioned to engage a cam cut in the receiver.

8. A firearm of claim 7 wherein a slot is formed in the bolt body, and the slot comprises interconnected sections comprising a rearward transverse section, a longitudinal middle section, and a forward transverse section, the forward transverse section being graduated in depth to be flush with the surface of the bolt body at the terminus of the slot, the firearm further comprising a detent pin located in the receiver and biased to engage the slot formed in the bolt body.

9. A firearm of claim 8, wherein the rearward transverse section of the slot is of greater width than the middle and forward transverse sections of the slot.

10. A firearm of claim 7 wherein the means for cocking the firing pin is a second cam cut in the rear of the bolt body positioned to interact with the means for connecting the firing pin to the trigger assembly.

11. A muzzle loading firearm comprising a barrel having a front end and a closed rear end and attached to a receiver; means for receiving a percussion cap operatively connected to a flash hole formed in the rear end of the barrel; a bolt assembly having a front and a rear end and positioned within the receiver behind and substantially aligned with the barrel, the bolt assembly being operatively connected to a trigger assembly and comprising a bolt body, a firing pin within the bolt body, a spring positioned within the bolt body to bias the firing pin forward, means on the firing pin positioned to connect the firing pin to the trigger assembly, means for cocking the firing pin, means for retaining the firing pin and firing pin spring within the bolt body, and means for movement of the bolt assembly longitudinally and rotationally within the receiver; a cam follower on a rear portion of the bolt body; and a cam cut in the receiver positioned to engage the cam follower on the bolt body.

* * * * *

US005718073B1

REEXAMINATION CERTIFICATE (4036th)

United States Patent [19] [11] B1 5,718,073

Sachse et al. [45] Certificate Issued Apr. 11, 2000

[54] MUZZLE LOADING RIFLE

[75] Inventors: T. Nick Sachse, Elizabethtown, Ky.; Kenneth W. Soucy, Neuchatel, Switzerland

[73] Assignee: Remington Arms Company, Inc., Wilmington, Del.

Reexamination Request:
No. 90/005,245, Feb. 2, 1999

Reexamination Certificate for:

| | |
|---|---|
| Patent No.: | **5,718,073** |
| Issued: | **Feb. 17, 1998** |
| Appl. No.: | **08/822,522** |
| Filed: | **Mar. 26, 1997** |

Related U.S. Application Data

[63] Continuation of application No. 08/603,586, Feb. 21, 1996, abandoned.

[51] Int. Cl.[7] ..... F41C 9/08

[52] U.S. Cl. ..... 42/51; 89/1.3; 42/16

[58] Field of Search ..... 42/51, 16, 17, 42/18, 19; 89/1.3

[56] References Cited

U.S. PATENT DOCUMENTS

| | | | |
|---|---|---|---|
| 1,168,026 | 1/1916 | Nelson | 42/16 |
| 1,322,227 | 11/1919 | Burton | 42/16 |
| 1,324,493 | 12/1919 | Burton | 42/16 |
| 1,331,154 | 2/1920 | Johnson | 42/16 |
| 2,069,887 | 2/1937 | Laudensack | 42/69 |
| 2,288,202 | 6/1942 | Mossberg | 42/16 |
| 4,715,139 | 12/1987 | Rodney, Jr. | 42/51 |

OTHER PUBLICATIONS

"The Remington 700", published by John F. Lacy, 1989.

*Primary Examiner*—Stephen M. Johnson

[57] ABSTRACT

An in-line muzzle-loading firearm in which the firing pin is cocked by a bolt action permits the use of a stronger firing pin spring, a firing pin of reduced mass, and reduced firing pin travel, resulting in reduced lock times.

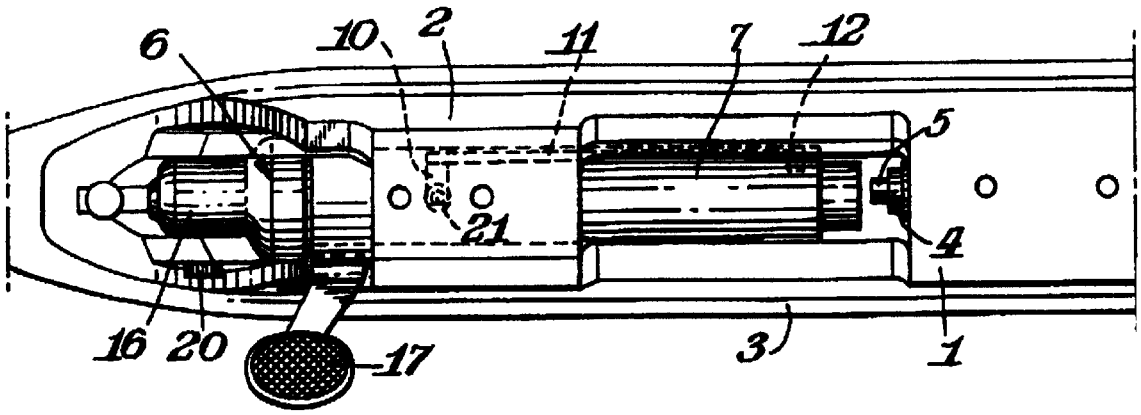

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–11 is confirmed.

* * * * *